US010174496B2

(12) United States Patent
Bertato

(10) Patent No.: US 10,174,496 B2
(45) Date of Patent: Jan. 8, 2019

(54) DECK BRACKET

(71) Applicant: Liv Building Products Inc., Uxbridge (CA)

(72) Inventor: Maurizio Bertato, Uxbridge (CA)

(73) Assignee: Liv Building Products Inc., Uxbridge, ON (CA)

( * ) Notice: Subject to any disclaimer, the term of this patent is extended or adjusted under 35 U.S.C. 154(b) by 0 days.

(21) Appl. No.: 15/459,779

(22) Filed: Mar. 15, 2017

(65) Prior Publication Data

US 2018/0112387 A1 Apr. 26, 2018

(51) Int. Cl.

| | |
|---|---|
| ***E04G 11/48*** | (2006.01) |
| ***E04B 1/19*** | (2006.01) |
| ***E04B 1/00*** | (2006.01) |
| ***E04B 1/41*** | (2006.01) |
| ***E04F 15/02*** | (2006.01) |
| ***E04F 15/04*** | (2006.01) |
| *E04B 1/38* | (2006.01) |

(52) U.S. Cl.

CPC ..... *E04B 1/0038* (2013.01); *E04B 1/1903* (2013.01); *E04B 1/40* (2013.01); *E04F 15/02044* (2013.01); *E04F 15/02183* (2013.01); *E04F 15/04* (2013.01); *E04B 2001/1957* (2013.01); *E04B 2001/1993* (2013.01); *E04B 2001/405* (2013.01); *E04F 2015/02116* (2013.01); *E04F 2015/02122* (2013.01)

(58) Field of Classification Search

CPC ..... F16L 59/135; B66B 13/30; E04G 17/16; E04G 17/18; E04G 17/04; E04G 11/48; E04G 21/26; E04B 1/19; E04B 2001/2415; E04B 2001/405; E04C 2/044

See application file for complete search history.

(56) References Cited

U.S. PATENT DOCUMENTS

| | | | | |
|---|---|---|---|---|
| 3,863,877 | A * | 2/1975 | Gregory | E04G 17/16 248/295.11 |
| 4,965,980 | A | 10/1990 | Leavens | |
| 5,497,593 | A | 3/1996 | Riesberg | |
| 5,775,048 | A | 7/1998 | Orchard | |
| 7,818,943 | B2 * | 10/2010 | Dziwak | B66B 13/30 16/94 R |
| 9,200,729 | B2 * | 12/2015 | Hobbs | F16L 59/135 |
| 2004/0094678 | A1 | 5/2004 | Burgess | |
| 2005/0218277 | A1 * | 10/2005 | Shaw | E04G 13/00 248/201 |

OTHER PUBLICATIONS

Decking & Dryspace, Installation & Maintenance Guide, TimberTech, Sep. 2012.

Camo Hidden Deck Fastening System Installation Instructions, CAMO Marksman Pro, www.camofasteners.com.

20 Pack, Teco 90mm Reinforced Galvanised Angle Bracket Decking/Joist/Timer, Falcon Workshop Supplies, www.ebay.co.uk.

* cited by examiner

*Primary Examiner* — Phi D A

(57) ABSTRACT

A deck board support bracket includes a drainage channel in a top surface of the bracket and deck boards are secured in an end to end manner with a space between two deck board ends centered over the drainage channel. Water presented on the deck surface at two deck board ends passes therebetween and to one side of a supporting joist. The deck board support bracket can be used with various deck board fastening arrangements and preferably is made of an injection molded plastic material.

8 Claims, 8 Drawing Sheets

DECK BRACKET

FIELD OF THE INVENTION

The present inversion relates to deck board support brackets and improvements associated with deck board securement at a joist.

BACKGROUND OF THE INVENTION

Perpendicular support trackers are commonly used to connect one surface to a second surface.

It has also been known to use perpendicular deck board mounting brackets which are made of metal and are used to support an end of the deck board. It is also known to use two perpendicular brackets to support the butt end the deck board on opposite sides of the deck board.

The most common approach for securing of deck boards to underlying joists is to have two abutting deck boards centered over a joist with the end of each deck board being attached to the joist. With this arrangement the deck boards abut on the center line of the joist and water can accumulate at this but joint. This type of securement can lead to rapid deterioration of the ends of the deck boards and the underlying joist. Furthermore, only a portion of each deck board overlaps the joist in contrast to deck boards which pass over the joist being fully supported by the joist. Typically when two deck boards abut and are centered over a joist, two screws are used to attach each deck board to the joist. These screws in combination with she abutting ends can lead to deterioration of the structure due to moisture accumulation etc.

The present invention utilizes a deck board support bracket to be secured to one side of the joist that provides a separate securement surface for one end of a deck board located to one side of the joist. Furthermore, rather than deck boards abutting, it is preferred to separate the ends of the deck boards and provide a drainage channel is provided between the abutting deck boards allowing water to pass therebetween.

SUMMARY OF THE INVENTION

A deck board support bracket according to the present invention comprises a back member, a top mount member positioned to one side of the back member generally at an upper edge of the back member, with at least two gusset supports forming a structural connection of the top mount member to the back member. A flow-through drainage arrangement is located between the back member and the top mount member. The drainage arrangement collectively provides a substantial drainage channel between the top mount member and the back member.

In an aspect of the invention, the at least two gussets form the major connection between the back member and the top member with two of the at least two gussets located at opposite ends of the cop mount member.

In a preferred aspect of the invention, the top mount member is spaced outwardly of the back member a distance of 0.25 to 0.50 inches.

In a further aspect of the invention the back member and the top mount, member form a perpendicular configuration.

In yet a further aspect of the invention the deck support bracket is of a unitary construction and made of an injection molded plastic material.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
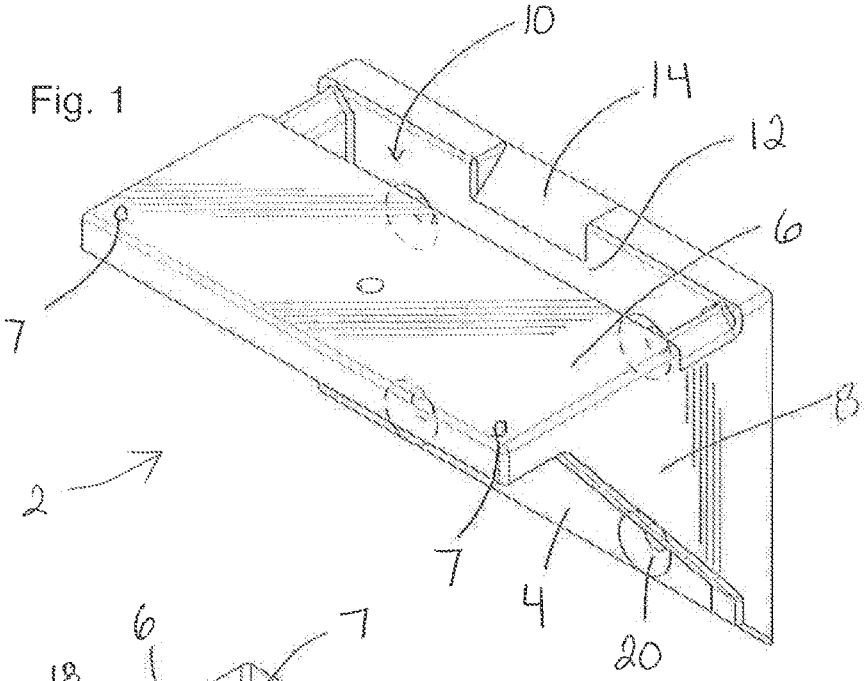
FIG. 1 is a front perspective view of the deck support bracket looking downwardly on the bracket.
Figure 2:
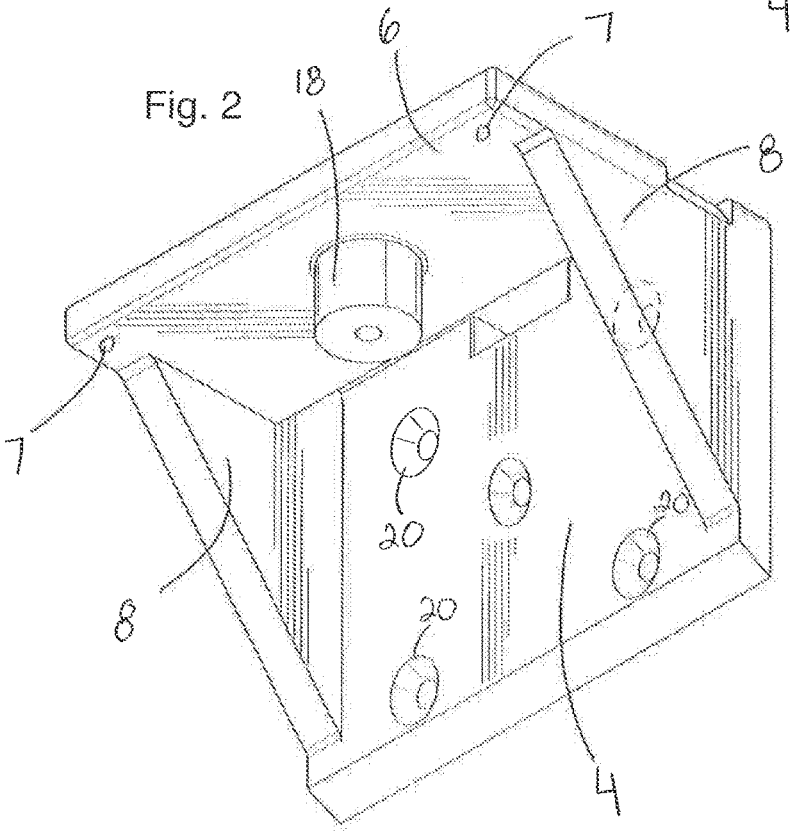
FIG. 2 is a front perspective view of the deck support bracket looking upwardly at a top of the member of the bracket.

The deck support bracket 2 shown in FIGS. 1 and 2 includes a back member 4 used to secure the deck support bracket 2 to a joist or other structure. A top mount member 6 is positioned to one side of and perpendicular to the back member 4 with a flow-through drainage arrangement 10 separating the back member 4 from the top mount member 6. The drainage arrangement 10 is preferably an open slot. At least two gusset supports 8 are provided that join the top mount member 6 to the back member 4. Depending upon the length of the deck support bracket 2, additional gusset supports can be provided. For many applications, only two gusset supports 8 will be provided. These gusset supports 8 are preferably provided adjacent the ends of the deck support bracket 2. The corner holes 7 are positioned to locate fasteners that pass through the holes and engage a deck board preferably at least one inch from a side of the deck board and at least one inch from the end of a deck board for securement from below the deck board.

The deck support bracket 2 is particularly useful when used with wooden deck boards and joists and other structures however it is also useful with all composite and PVC deck boards and/or joists and other structures and any combinations thereof. The type of material support by the bracket does appreciably impact the utility.

The back member 4 includes a series of screw ports 20 used to attach the back member to the face of a joist. In the particular embodiment shown, four such screw ports 20 are provided however the positioning, placement and the number of screw ports can vary.

Figure 5:
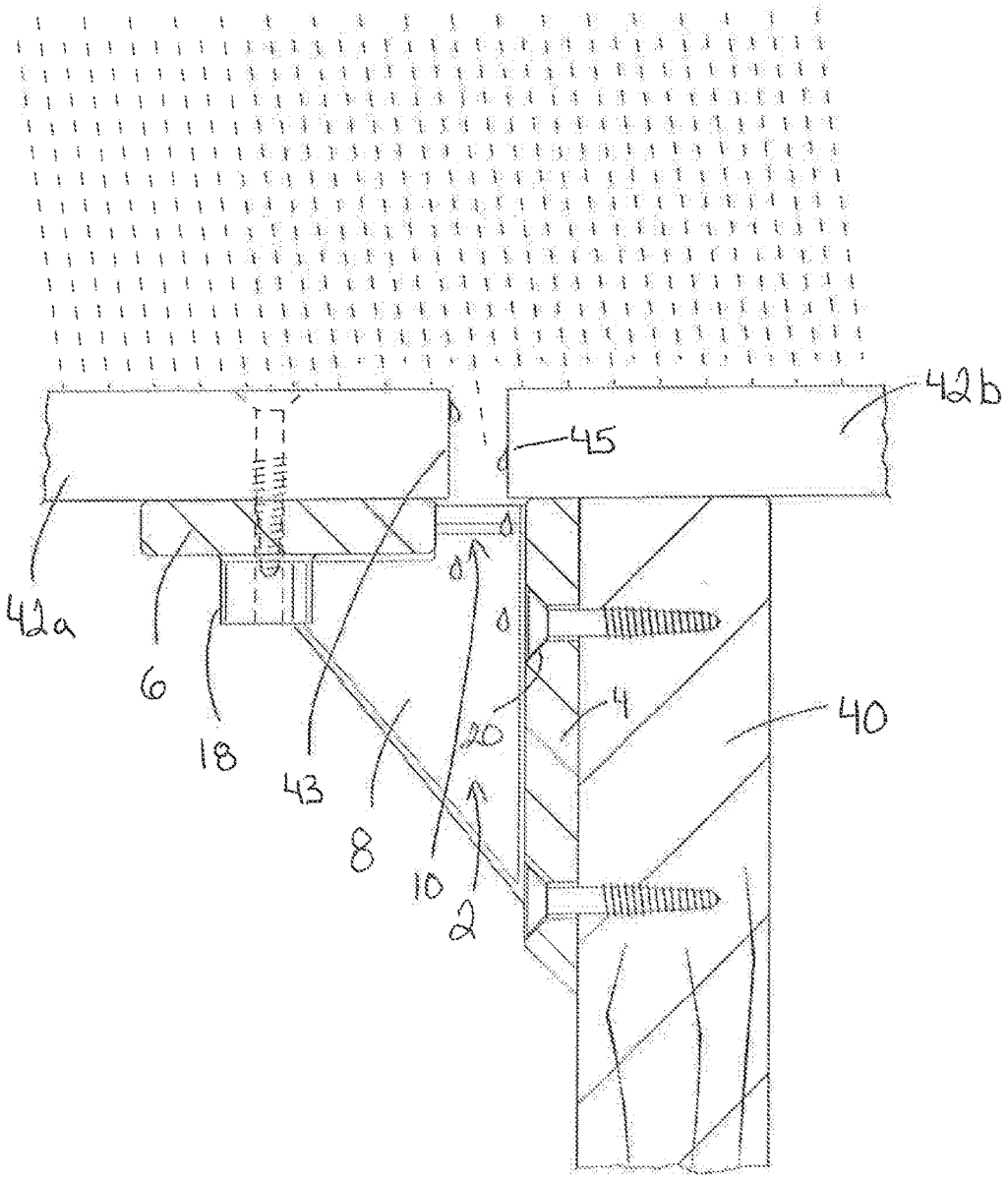
FIG. 5 is a side view through a decking structure where the deck support bracket is attached to a joist and one deck board partially overhangs the joist and a second deck board has an end thereof spaced outwardly from the joist and supported by the bracket.

The deck support bracket 2 is preferably used such that the angle drainage face 14 is positioned in a gap between parallel deck boards. As is shown in FIG. 5, the present deck support bracket 2 is advantageously used to allow moisture to pass through the deck and in particular allow moisture to pass between two deck boards which are positioned end to end but have a gap therebetween (spaced butt joint).

The deck support bracket 2 as shown in FIG. 2 includes a securing boss 18 generally on a center line with respect to the width of the bracket and this securing boss can be used with respect to the particular fastening arrangement for securing adjacent parallel deck boards.

The deck support bracket 2 is preferably of a unitary construction and preferably is injection molded using a suitable plastic material. The particular plastic or reinforced plastic material can be appropriately selected in accordance with the required design load characteristics.

The at least two gusset supports 8 form a strong mechanical connection between the top mount member 6 and the back member 4. These gusset supports resist deflection of the top mount member 4 and effectively form braces between a joist and the end of a deck board which is positioned to one side of the joist.

Figure 3:
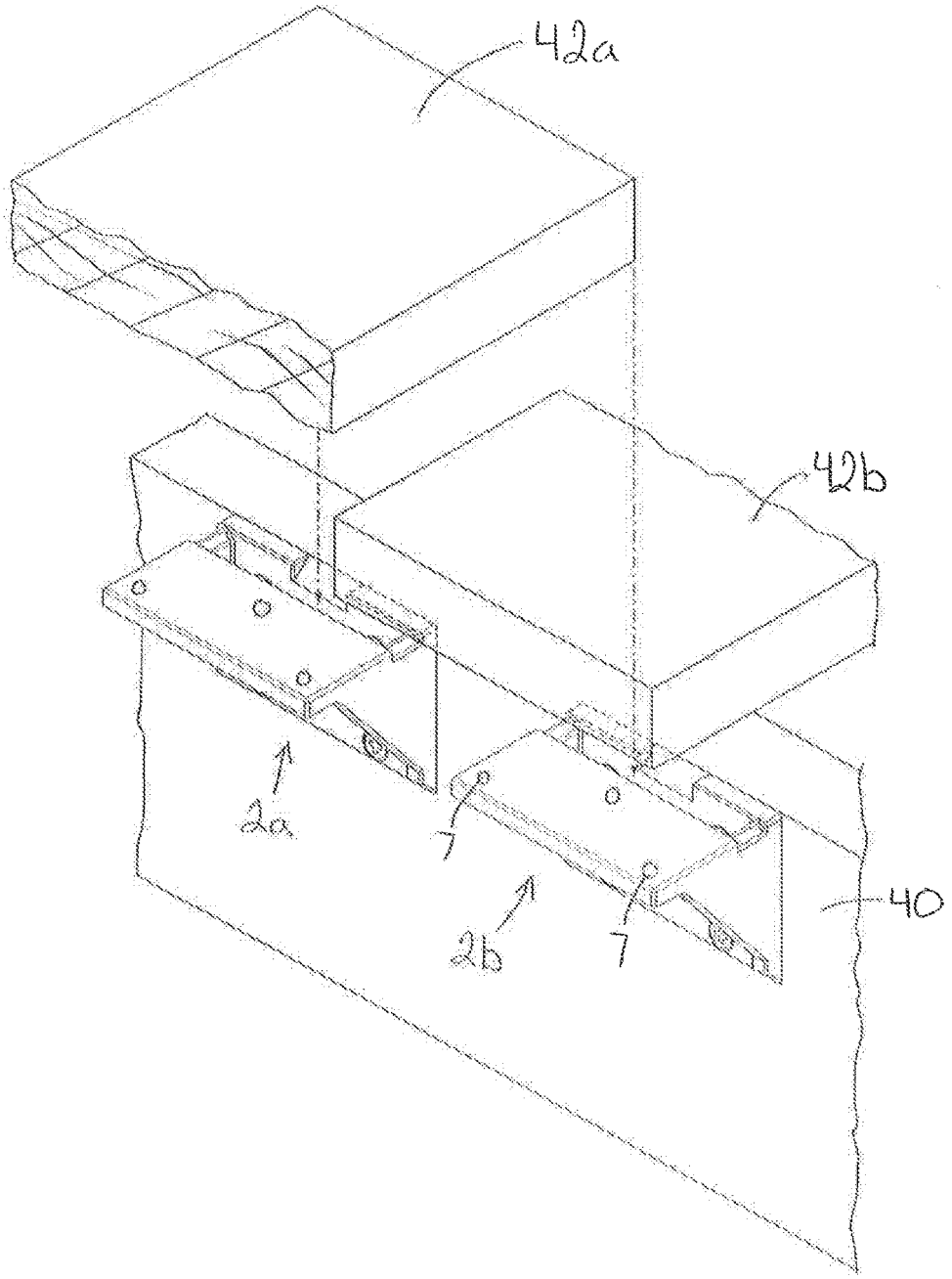
FIG. 3 is a partial perspective view showing two deck support brackets secured to a joist about to secure and support an end of a deck board to one side of the joist.
Figure 4:
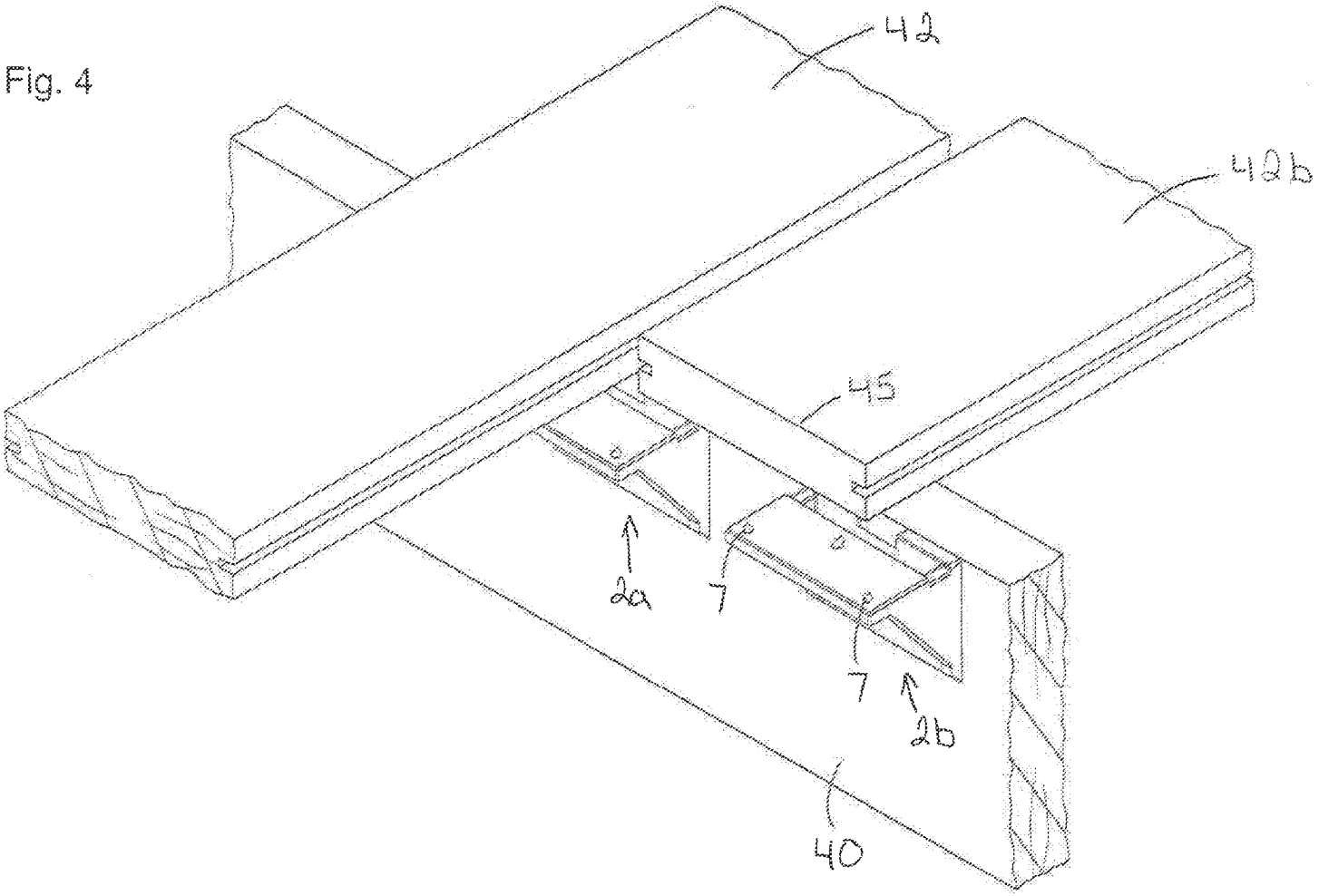
FIG. 4 is a perspective view of one two deck support brackets secured for supporting an end of a further deck board (not shown)

As shown in FIGS. 3 and 4, two deck support brackets 2*a* and 2*b* are used to support the butt end of deck board 42*a* about to be secured. The end of deck board 42*a* will not overlie the joist 40 as it is spaced to one side of the joist. The two deck board support brackets 2*a* and 2*b* provide the structural connection between the joist 40 and the end of the deck board 42*a*. Furthermore the deck board 42*b* is positioned to have its butt end 45 at least overlapping with the joist 40 and in the preferred embodiment as shown partially overhangs the joist 40.

FIG. 4 shows a preferred arrangement where the adjacent deck board 42 passes over the joist and over part of the deck support bracket 2*a*. AS shown in FIG. 4 any moisture that comes into contact with the deck at a position of the two abutting deck boards 42*a* and 42*b* would freely pass through the drainage gap provided by each of the deck board support brackets. In addition, it can be appreciated that there is a portion of the deck board 42*a* that is intermediate the two deck support brackets 2*a* and 2*b* and water can pass between the opposed spaced ends of the deck boards 42*a* and 42*b*.

With this arrangement, the opposed ends of each of the deck boards 42*a* and 42*b* are less prone to deterioration caused by exposure to moisture over an extended period of time. Furthermore the underlying joist 40, and particularly the top surface thereof, is less prone to damage due to accumulated moisture as the deck boards do not abut at the joist and deck boards 42*a* and 42*b* do not abut over what would be the center line of the joist 40.

The sectional view of FIG. 5 shows the deck board 42*a* supported by the deck support bracket 2 such that the end 43 of the deck board 42*a* is located over the flow through drainage arrangement 10. The deck board 42*b* and its end 45 pass over the joist 40 and the end 45 is preferably generally aligned with the back member 4. With this arrangement deck board 42*b*, as it passes over the joist 40, protects the joist and the end 45 of the deck board 42*b* is less prone to damage as moisture is encouraged to pass between the two ends 43 and 45 rather than accumulate between such ends.

As shown in FIG. 5 the possible securement length for deck boards 42*a* and 42*b* has dramatically increased due to the top surface of the deck support bracket 2. Deck board 42*b* overhangs joist 40 and any fastener such as a screw can pass through the deck board at least 0.75 to 1.0 inches from the end of the board. This is within the recommended distance to avoid splitting or cracking. Essentially deck board 42*b* has the entire width of the joist plus a small overhang that can be used for securement (see FIG. 4).

Deck board 42*a* can also be secured with sufficient spacing from the end thereof due to the width of the top mount member 6.

For wood deck boards the recommended spacing from the end of a deck board is one inch. With a joist width of 1.5 inches and a partial overhang this can be realized for both deck boards 42*a* and 42*b*.

The deck support bracket 2 accommodates different securement with appropriate spacing from the ends of the deck boards.

As shown in FIG. 2 and 4, the preferred arrangement for supporting of the deck boards 42*a* and 42*b* using this type of connection, uses two deck support brackets 2 with each of these brackets essentially centered in the gap between parallel deck boards and supporting tin end of a deck board spaced to one side of the joist.

FIGS. 6 through 9 show different fastening arrangements for securing of deck boards to the top mount member of the deck support bracket.

Figure 6:
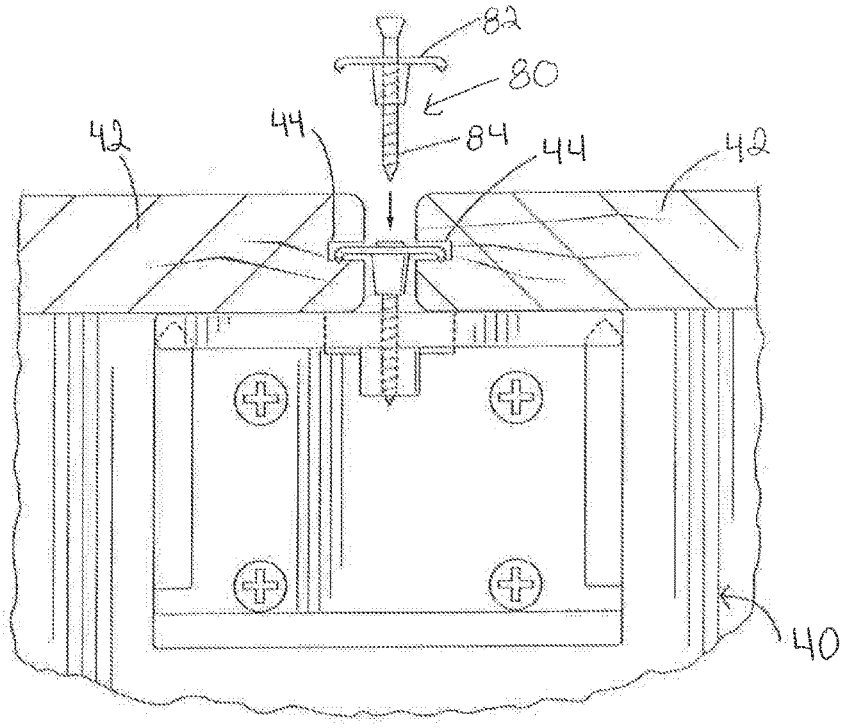
FIG. 6 is an end view showing the deck support bracket used to secure two adjacent deck boards using a specialized central fastening arrangement.
Figure 7:
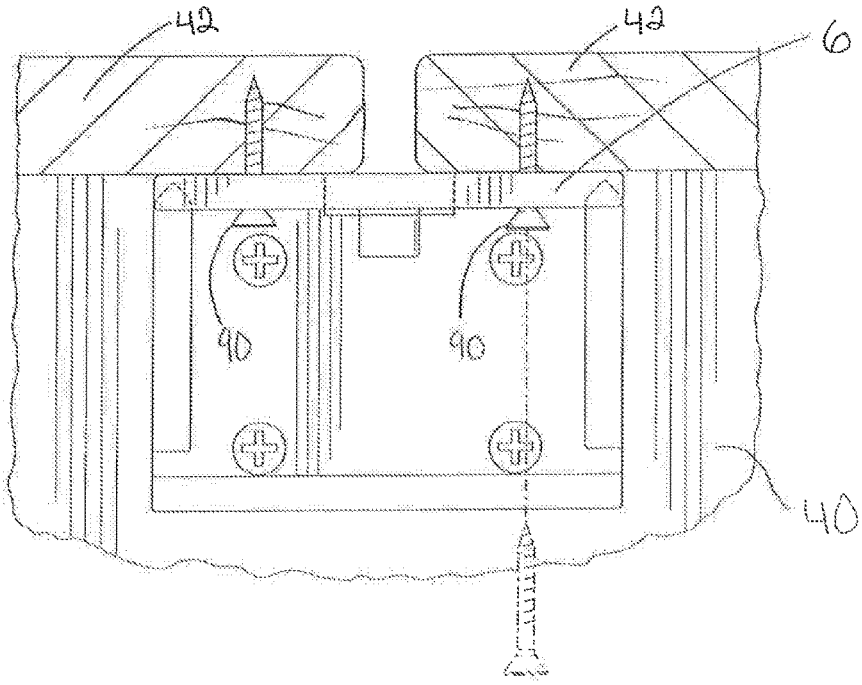
FIG. 7 is a view similar to FIG. 5 stowing the bracket being used with screws for securing deck boards from below the deck surface.

FIGS. 6 and 7 show the deck support bracket 2 in combination with a hidden fastener type arrangement for securing of deck boards. The injection molded deck support bracket 2 allows engagement with a diverse group of fasteners and different orientations in contrast to specialized dedicated systems.

In FIG. 6 the deck boards 42 on the sides thereof include an elongate securing slot 44 for use with the specialized securing member 80. Member 80 includes a plate member 82 that engages each of these slots of the deck boards 42 and a screw fastener 84 is positioned to pass through the top mount member 4 and into the underlying securing boss 18. The fastening arrangement 80 would also be used with respect to securing of deck boards to joists where each of the deck boards pass over a joist. With respect to the securing arrangement of FIG. 3, the deck board 42*b* would have one of these fasteners securing of the deck board to the joist 40 and the deck board 42*a* would have this type of fastener securing the end of 42*a* to the top member of the support bracket. Where deck boards 42*a* and 42*b* are supported as shown in FIG. 3, deck board 42*a* will be secured to the top member 6 and the deck board 42*b* will be directly secured to the joist 40.

There are also other securing arrangements, such as shown in FIG. 7, where fasteners are provided below the deck surface and extend from below the deck surface upwardly to secure the deck beards. Different types of fastening arrangements are used to perform under deck fastening however the deck support bracket 2 can have fasteners 90 pass through the top member 6 and appropriately engage the deck boards.

Figure 8:
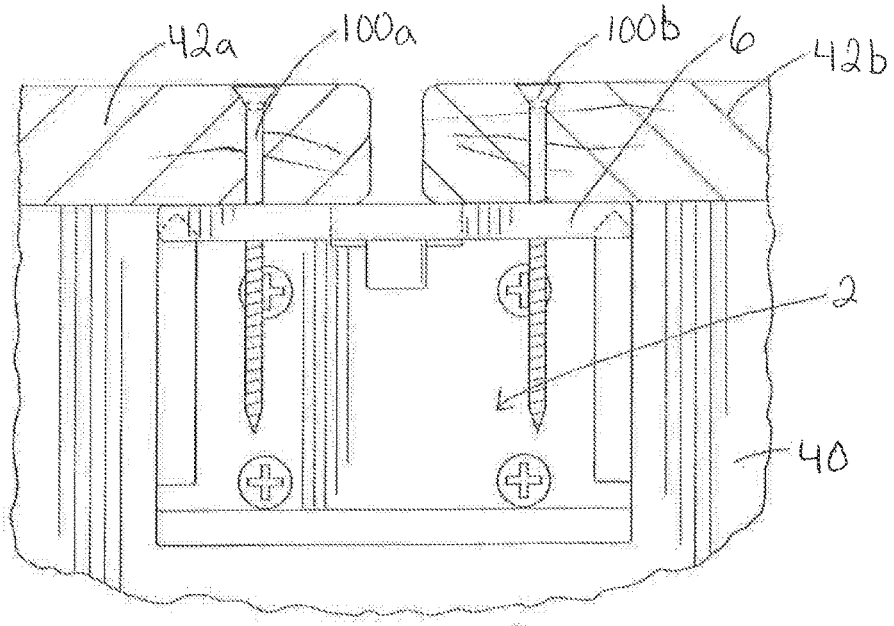
FIG. 8 is a view showing deck boards being secured by passing screws through the top of the deck boards and into the deck board support bracket.

FIG. 8 illustrates a more conventional use of the deck support bracket 2 and fasteners 100 that pass through the deck boards and engage the top member 6. If the end of the deck board 42*a* is positioned to one side of the joist 40 then fastener 100*a* would pass through the top member 6. In contrast, if deck board 42*b* passes completely over both the joist 40 and the deck support bracket 2, the screw 100*b* would preferably engage the joist 40. In the embodiment shown, deck board 42*b* is attached to the top member 6 and a further screw, not shown, would pass through the deck board 42*b* and engage the joist 40. The additional screw

100*b* can provide some additional assistance in maintaining the positron of the top mount member 6 as it is attached to the continuous deck board 42*b*.

Figure 9:
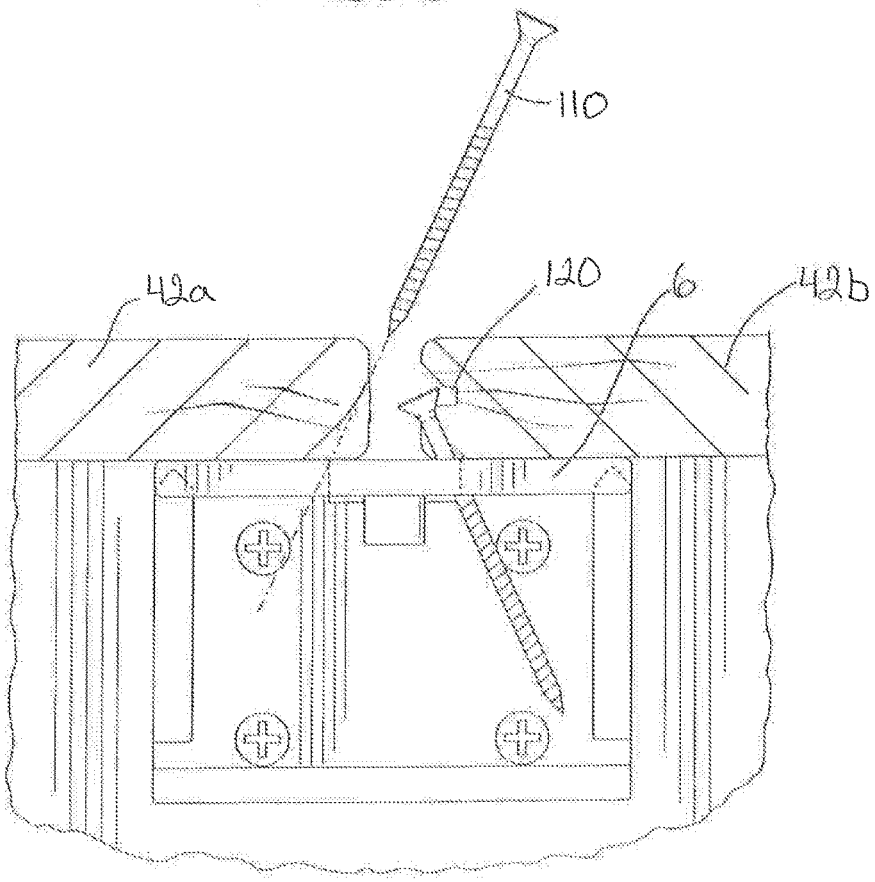
FIG. 9 is a view showing screws being used in combination with slotted deck boards for securing of the deck boards to the deck support bracket.

FIG. 9 shows yet a further fastening arrangement, where the screws 110 are driven from above at an angle and pass through the slots 120 and engage the top mount member 6. This type of angled screw securement still provides a hidden-type fastening of the deck boards 42 to the underlying support structure. The deck boards 42*a* and 42*b* are shown as having slots 120 however these deck boards could be conventional wood deck boards with the screws passing at an angle through the sides thereof. Normally when deck boards are side by side as shown in FIG. 9, one of the deck boards will continue over the joist and deck support bracket 2 and the end of the board will be at a different location (see FIG. 4). Securing both side by side boards to the top mount member 6 improves structural integrity.

Figure 10:
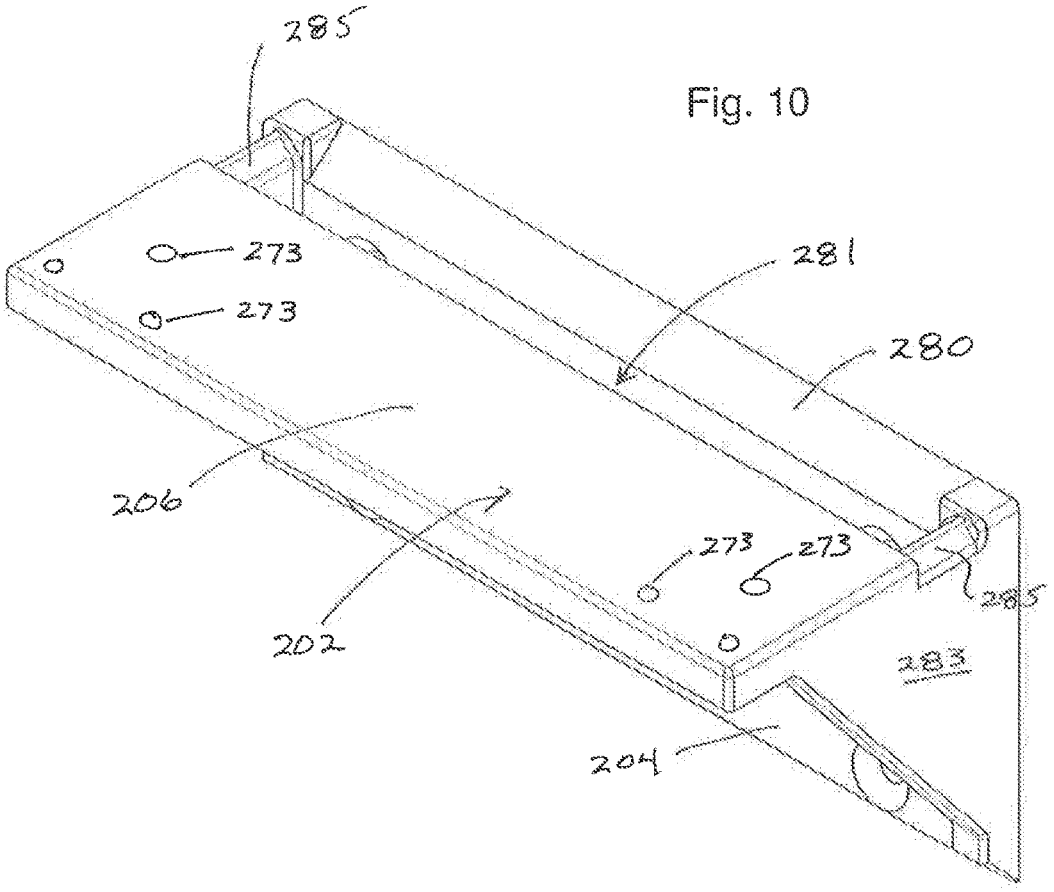
FIG. 10 is a perspective view of a modified deck board support bracket which is of an increased size for different applications bridging underneath a board for attachment on opposite sides of the board.
Figure 11:
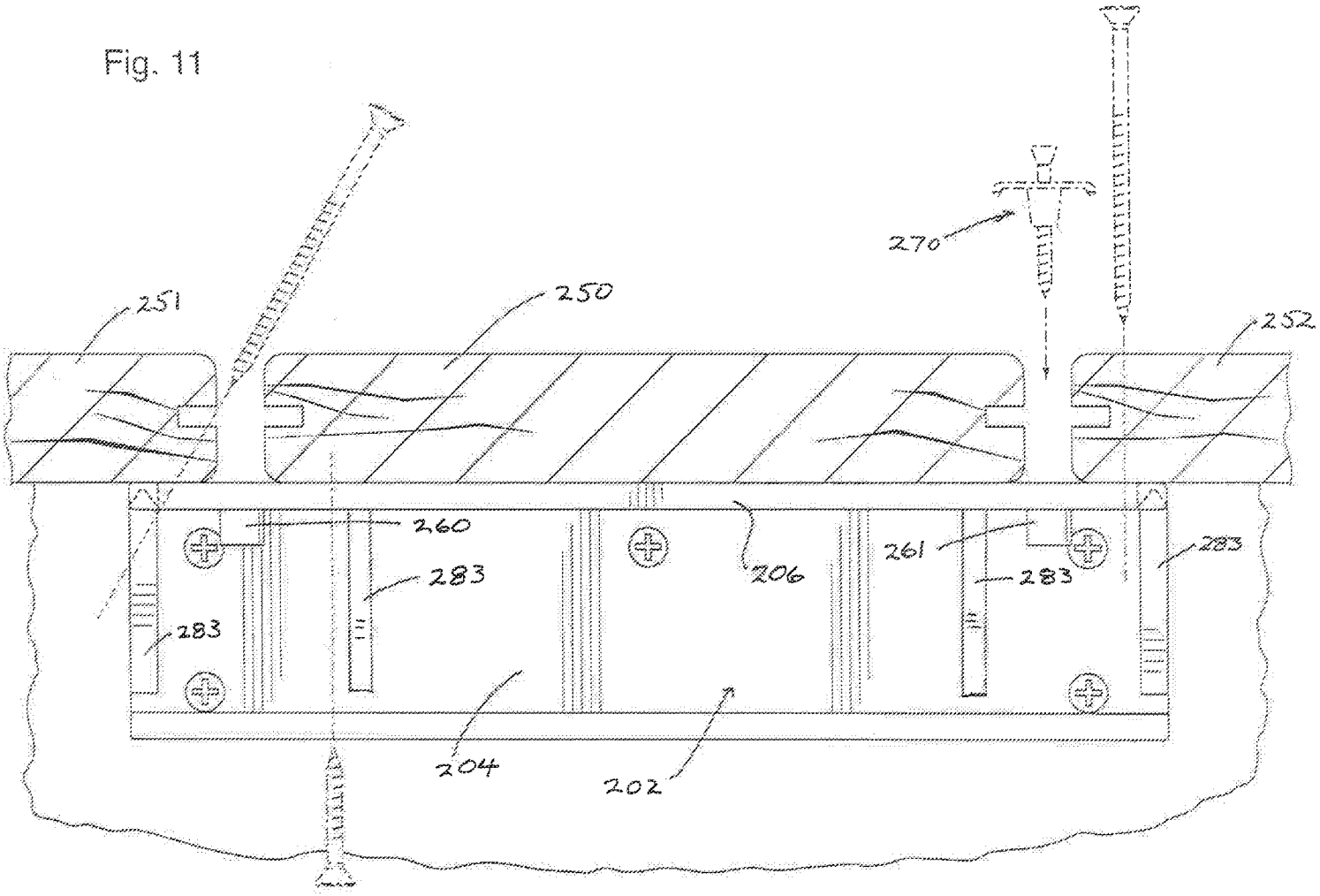
FIG. 11 is a sectional view illustrating the modified deck support bracket of FIG. 10 used to support three deck boards.

The deck support bracket 2 as shown in FIG. 1 and 2, as well as the deck support bracket 202 (FIG. 10), is specifically designed to provide a desirable spaced abutting-type connection of two deck boards to one side of an underlying joist. The deck support bracket 202 is of increased length and can be used with larger sire deck boards and/or used with smaller deck boards such that one bracket can be used to underlie one full board and partially underlie the two adjacent deck boards. The deck support bracket 202 includes the back member 204, the top mount member 206 and the support gussets 283.

The central board 250 extends over the joist but stops on the bracket. Deck boards 251 and 252 are through boards. With extended bracket 202 two bosses 260 and 261 are positioned in the gaps between boards for receiving the fastener 270 for engaging board slots as previously described. A sloped drainage edge 280 runs generally to the width of the bracket 202. Four gussets 283 are shown but additional gussets may be provided. This bracket is capable of receiving top down screws, bottom up screws and diagonal screws. The bracket is typically about 7.5 inches wide when used for 5½ inch boards. Six ports 273 can be used for bottom up screws. The bracket 202 adjacent the back member 204 includes a drainage slot 281. The end walls of the drainage slot 281 include an angled top surface 285 to promote drainage. The drainage slot 281 is positioned between end to end deck boards and any moisture is encouraged to pass through the slot protecting any deck boards adjacent the slot.

A number of different fastening arrangements have been described and these fastening arrangements can be used in combination.

It can also be appreciated that these deck support brackets 2 and 202 can advantageously be used in other applications where it is desirable to secure deck boards to underlying joists. For example, many deck configurations now use deck boards at different angles or deck boards used to define a very unique pattern and these brackets can also be used as conventional type support brackets.

In the preferred embodiment the ends of the deck boards are shown with an appreciable cap between abutting ends. This as normally preferred, however in some applications a smaller gap can be used while still providing the desirable drainage between abutting deck boards. Therefore significant variations are available to the end user to accommodate particular requirements or configurations.

The deck board support brackets are preferably made of a suitable plastic or injection molding material, however, a bracket made of steel or metal is also a practical alternative. Typically, such a metal bracket would be formed as part of a progressive stamping/bending process. Therefore, the present invention is not limited to an injection molded product and a deck board bracket of a metal or other material having the claimed features is also included.

Although preferred embodiments of the invention nave been described here in detail, it will be understood by those skilled in the art that variations may be made thereto, without departing from the invention, as described and claimed in the present application.

The embodiments of the invention in which an exclusive property or privilege is claimed are defined as follows:

1. In combination a deck support bracket, a support joist and first and second deck boards generally aligned and extending perpendicular to said support joist; said deck support bracket being secured to one side of said support joist with said deck bracket supporting an end of said first deck board and said support joist supporting an end of said second deck board directly above said support joist; and wherein said deck support bracket comprises a back member secured to said joist, a top mount member separated from and spaced outwardly of said back member and said support joist generally at an upper edge of said back member with said top mount member supporting said end of said first deck board; said deck support bracket further including two gusset supports joining said top mount member to said back member and cooperating therewith to define an elongate drainage port located at an edge of said back member facing said top mount member, said elongate port defining an open clear space between said ends of said first and second deck boards allowing water to pass between the ends of said first and second deck boards and through said elongate drainage port past said top mount member and to said one side of said support joist.

2. In combination as claimed in claim 1 wherein said at least two gussets form the major connection between said back member and said top mount member with two of the at least two gussets located at opposite ends of said top mount member.

3. In combination as claimed in claim 1 wherein said top mount member is spaced outwardly of said back member a distance of 0.25 to 0.50 inches.

4. In combination as claimed in claim 1 wherein said deck support bracket is of a unitary construction and made of an injection molded plastic material.

5. In combination as claimed in claim 4 wherein said top mount member is spaced outwardly of said back member a distance of 0.25 to 0.50 inches.

6. In combination as claimed in claim 1 including a securing boss located on and projecting downwardly from a lower surface of said top mount member.

7. In combination as claimed in claim 1 wherein said end of said first deck board is secured by a screw fastener to said top mount member at a position greater than about 1 inch from the end thereof.

8. In combination as claimed in claim 1 wherein said end of said second deck board covers said support joist with respect to a width of said support joist.

* * * * *